US011007414B2

(12) United States Patent
Lamark

(10) Patent No.: US 11,007,414 B2
(45) Date of Patent: May 18, 2021

(54) MARTIAL ARTS TRAINER WITH ROTATING ARMS

(71) Applicant: Abraham Lamark, Des Moines, IA (US)

(72) Inventor: Abraham Lamark, Des Moines, IA (US)

( * ) Notice: Subject to any disclaimer, the term of this patent is extended or adjusted under 35 U.S.C. 154(b) by 97 days.

(21) Appl. No.: 15/888,609

(22) Filed: Feb. 5, 2018

(65) Prior Publication Data

US 2018/0221745 A1 Aug. 9, 2018

Related U.S. Application Data

(60) Provisional application No. 62/454,252, filed on Feb. 3, 2017.

(51) Int. Cl.
*A63B 69/20* (2006.01)
*A63B 69/00* (2006.01)

(52) U.S. Cl.
CPC ..... *A63B 69/205* (2013.01); *A63B 69/004* (2013.01); *A63B 69/201* (2013.01); *A63B 69/206* (2013.01); *A63B 69/208* (2013.01); *A63B 2209/00* (2013.01); *A63B 2225/093* (2013.01)

(58) Field of Classification Search
CPC ..... A63B 69/20–345; A63B 2209/00; A63B 2225/093; A63B 21/02; A63B 21/04; A63B 21/0407; A63B 21/0414; A63B 21/0421; A63B 21/0435; A63B 21/055; A63B 21/0552; A63B 21/0557
See application file for complete search history.

(56) References Cited

U.S. PATENT DOCUMENTS 843,389 A * 2/1907 Brown ..... A63B 69/208 482/90
4,749,185 A * 6/1988 Spears ..... A63B 69/206 482/89

(Continued)

OTHER PUBLICATIONS

Physical Success Partners, Double End Bag Speed Ball, Date First Listed on Amazon: Jun. 5, 2007, [retrieved on Jul. 16, 2019]. Retrieved from <URL: https://www.amazon.com/Double-End-Bag-Speed-Ball/dp/B000PE30CG/ref=sr_1_72?qid=1563294825&s=sports-and-fitness&sr=1-72#immersive-view_1563302261311> (Year: 2007).*

(Continued)

*Primary Examiner* — Loan B Jimenez
*Assistant Examiner* — Zachary T Moore
(74) *Attorney, Agent, or Firm* — McKee, Voorhees & Sease, PLC

(57) ABSTRACT

A martial arts training apparatus includes an adjustable length pole to be supported between a ceiling and a floor in a generally vertical orientation. A plurality of rotatable collars are provided on the pole. Arms extend from the collars and are free to rotate in opposite directions around the pole when struck to provide targets for striking and to mimic an opponent's limbs to be blocked or dodged. A static strike target may be provided on the pole. The apparatus can be configured to support a double end speed bag from one of the arms such that the double end speed bag moves in a dynamic unpredictable manner when struck. A support arm may be provided to connect the top arm to a lower collar to provide additional support of the double end speed bag.

10 Claims, 2 Drawing Sheets

(56) References Cited

U.S. PATENT DOCUMENTS

| | | | | |
|---|---|---|---|---|
| 5,389,057 | A | 2/1995 | Zagata, Jr. | |
| 5,554,088 | A * | 9/1996 | Zlojutro | A63B 69/004 482/83 |
| 5,722,920 | A * | 3/1998 | Bauer | A63B 69/004 482/83 |
| 5,725,458 | A * | 3/1998 | Newman | A63B 69/201 482/83 |
| 2004/0176222 | A1* | 9/2004 | Mitchell | A63B 69/004 482/83 |
| 2006/0025284 | A1 | 2/2006 | Livingstone et al. | |
| 2010/0179031 | A1 | 7/2010 | Luigi | |
| 2012/0129660 | A1* | 5/2012 | Eem | A63B 69/24 482/83 |
| 2015/0290518 | A1* | 10/2015 | Hudson | A63B 69/201 482/90 |
| 2018/0021650 | A1* | 1/2018 | Hoover | A63B 69/20 482/83 |

OTHER PUBLICATIONS

Task Tools, Quick Support Rods & Accessories Features & Usage Guide, www.task-tools.com, pp. 1-4, last accessed on Feb. 19, 2018.

* cited by examiner

MARTIAL ARTS TRAINER WITH ROTATING ARMS

CROSS-REFERENCE TO RELATED APPLICATIONS

This application claims priority to provisional application U.S. Ser. No. 62/454,252 filed Feb. 3, 2017, which is incorporated herein by reference in its entirety.

FIELD OF THE INVENTION

The invention relates generally to athletic training equipment. More specifically, but not exclusively, the invention relates to a martial arts training apparatus.

BACKGROUND OF THE INVENTION

Martial arts provide many benefits, including self-defense, strength, cardiovascular improvement, flexibility, hand-eye coordination, self-confidence, and enjoyment. Three essential skills in many martial arts are striking, blocking, and dodging. Home training aids can be beneficial to students and practitioners of martial arts in learning and improving striking, blocking, and dodging skills.

Therefore, a primary objective of the present invention is the provision of an apparatus that permits a user to train blocking, striking, and dodging skills at the same time on a single apparatus.

Accordingly, a primary objective of the present invention is the provision of a training device from which improves the skills of martial art students.

Another objective of the present invention is the provision of a martial arts training device having rotating arms for hitting by a trainee.

A further objective of the present invention is the provision of an extendible pole mountable between a floor and ceiling for use in training and improving the skills of a martial art practitioner.

Still another objective of the present invention provision of a martial arts training device having rotatable arms with padded targets that can be hit from either side.

Yet another objective of the present invention is a provision of a martial arts training device that allows practice on striking, blocking, and dodging.

Another objective of the present invention is a provision of a martial arts training device that can be quickly and easily set up in the home for martial arts practice.

These and/or other objectives, features, and advantages of the invention will be apparent to those skilled in the art.

SUMMARY OF THE INVENTION

A martial arts training device includes a pole having a top end and bottom end and is oriented and positioned in a generally vertical orientation. The pole may be extendable to create a friction fit between a floor and a ceiling. The top end of the pole may be anchored to the ceiling. One or more arm members are rotatably mounted on the pole and extend outwardly in a generally horizontal direction. The one arm members may be slidably positioned along the length of the pole. The inner end of each arm member is rotatable about the pole, while the outer end of each arm is configured to removably attach an impact absorbing member. The arms are configured to rotate independent of one another. The impact absorbing members may be selected from the group comprising an arm bar, padded arm, paddle, speed bag, or heavy bag. The speed bag may be attached via elastic bands or bungee cords to the outer end of one of the arms and to a weighted base.

According to another embodiment, the invention is an in-home martial arts training system for practicing blocking, striking, and dodging. The system includes a support pole that has an upper end and a lower end. The upper end has ceiling engaging hardware and the lower end has floor engaging hardware. The pole includes a length adjustment mechanism to adjust a distance between the ceiling engaging hardware and the floor engaging hardware. An upper collar is secured to the pole. The upper collar being adapted to receive an upper arm such that the upper arm extends transversely away from the pole and such that the upper arm will rotate freely around the pole. Similarly, a middle collar is secured to the pole, and is adapted to receive a middle arm such that the middle arm extends transversely away from the pole and such that the middle arm will rotate freely around the pole. A lower collar is also secured to the pole, and is adapted receive a lower arm such that the lower arm extends transversely away from the pole and such that the lower arm will rotate freely around the pole. A double-end bag is hangably attachable to one of the arms on a resilient member such that the double-end speed bag will react dynamically and unpredictably when struck by a user. The collars may be selectively slidable along the pole. Targets may be provided on the distal ends of one or more of the arms. A static target may be provided on the pole.

The invention is not to be limited to or by the objectives, features and advantages. No single embodiment need provide each and every object, feature, or advantage.

DETAILED DESCRIPTION

Figure 1:
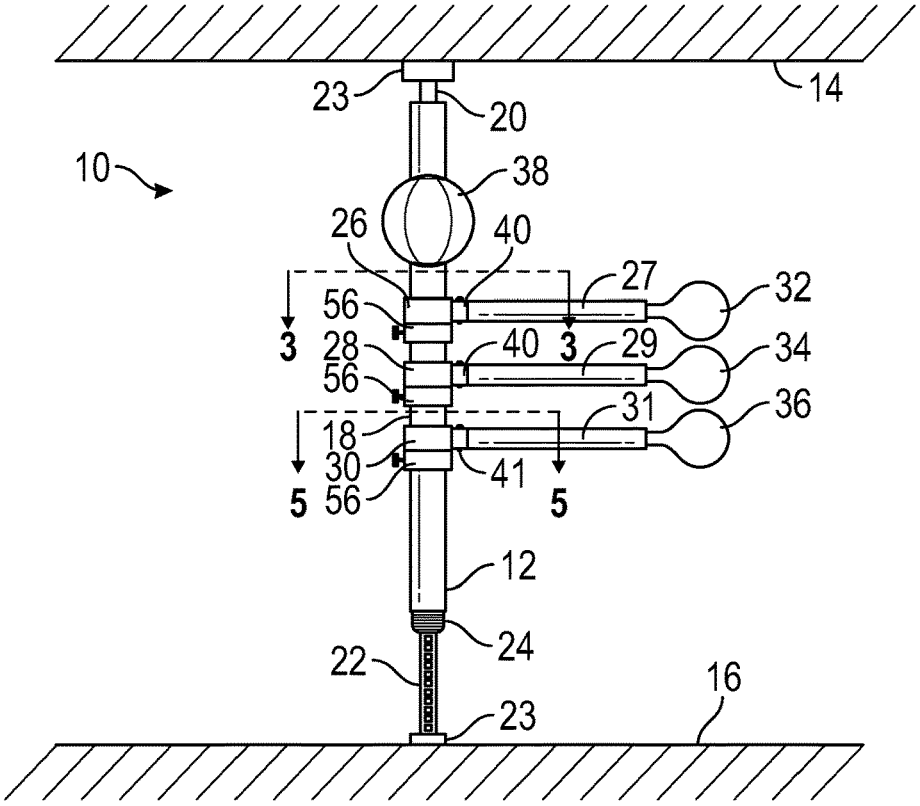
FIG. 1 is a side elevation view of martial arts training apparatus according to one embodiment of the present invention.

Various embodiments of the invention will be described in detail with reference to the drawings, wherein like reference numerals represent like parts throughout the several views. Reference to various embodiments does not limit the scope of the invention. Figures represented herein are not limitations to the various embodiments according to the invention and are presented for exemplary illustration of the invention.

Figure 2:
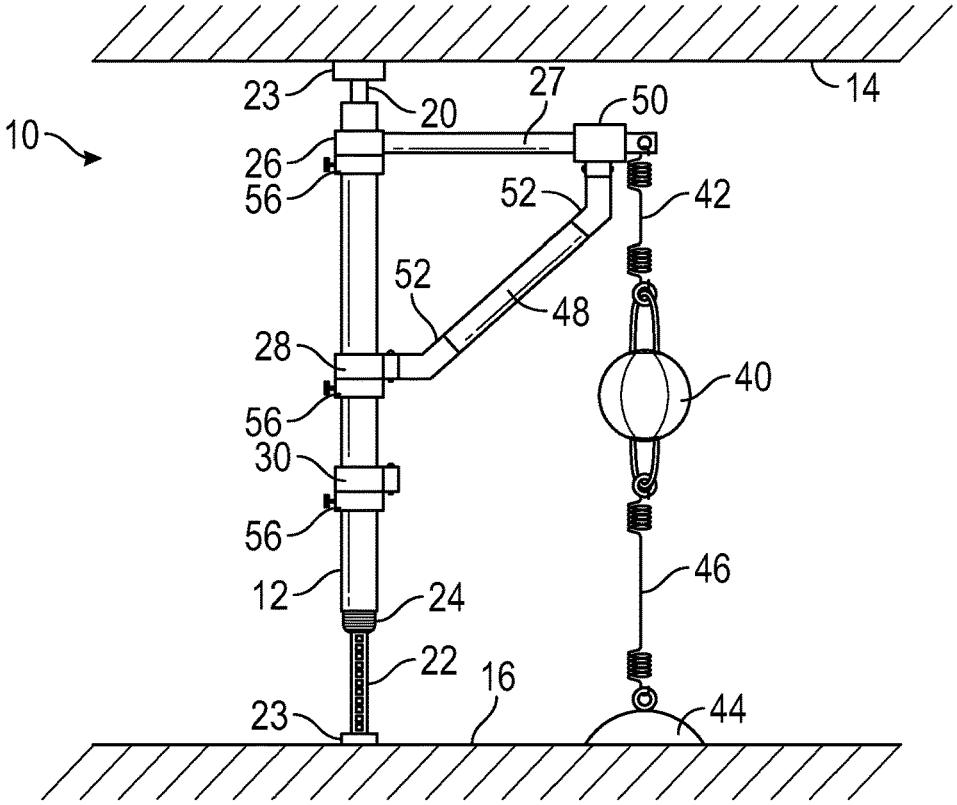
FIG. 2 is a side elevation view of the martial arts training apparatus of FIG. 1 with a double-end bag attached to one of the rotatable arms.

The invention is directed towards a martial arts training apparatus 10. As seen in FIGS. 1 and 2, the apparatus 10 includes a pole 12 that extends between the ceiling 14 and the floor 16. The pole 12 may be extendable to fit a variety of ceiling heights. According to the embodiment of FIGS. 1 and 2, the pole 12 includes a central portion 18, an upper end to engage the ceiling 14, and a lower end 22 to engage the floor 16. The lower end 22 is extendable and retractable from the central portion 18. The extending and retracting feature can be accomplished through a variety of known mechanisms. In the embodiment shown, a ratcheting jack 24 is used to extend and retract the floor engaging portion 22. The upper and lower ends 20, 22 may have feet that have non-marking friction pads 23 to engage the floor 16 and ceiling 14 so as to hold the pole 12 upright in a friction fit between the floor 16 and the ceiling 14. Alternatively, the upper and lower ends 20, 22 could be permanently fixed in place with threaded fasteners or the like. As a further alternative, either end of the pole 12 could be securely fixed, such as in concrete. It should also be appreciated that the ceiling engaging portion 20 could be made extendable and retractable relative to the central portion 18 of the pole 12, such that the length adjustment of the pole 12 could be accomplished at the upper end, rather than, or in addition to, the adjustability at the lower end.

Figure 3A:
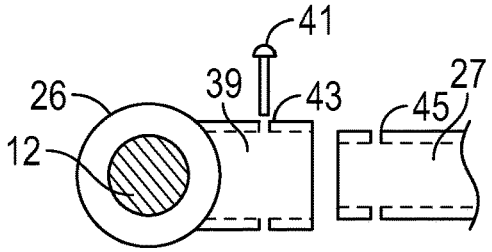
FIG. 3A is a view taken along lines 3-3 of FIG. 1, with the arm exploded from the collar to show a pinned female/male connection between the collar and the arm.
Figure 3B:
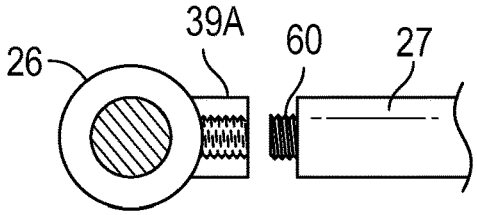
FIG. 3B is a view similar to FIG. 3A showing an alternative threaded female/male connection between the collar and the arm.
Figure 3C:
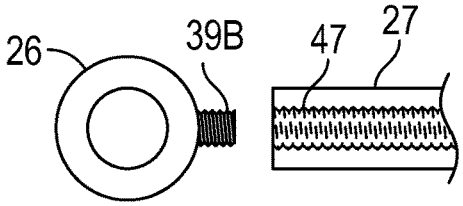
FIG. 3C is another alternative threaded male/female connection between the collar and the arm.

In the embodiment shown in the drawings, three collars 26, 28, and 30 are rotatably mounted on the central portion 18 of the pole 12. The number of collars can be varied without departing from the scope of invention. The collars 26, 28, 30 provide an attachment point for arms 27, 29, and 31. The connection between the collars and arms can be male and female connectors with quick couplers, such as ball and detent, or retention pins or set screws. For example, in FIG. 3A, a female receivers. 39 extends from the collar 26 for receipt of the end of the arms 27. A retention pin 41 extends through aligned holes 43, 45 in the receiver 39 and arm 27, respectively. As shown in FIG. 3B, an alternative connection is a threaded male stub 6042 on the end of the arm 27 threaded into a female socket 39A on the collar 26. As another alternative, the collar can have a threaded shaft 39B and the hollow arm can have internal threads 47, as shown in FIG. 3C.

The collars 26, 28, 30 can be adjusted up and down along the central portion 18 of the pole 12 in order to adjust the height of the respective arms 27, 29, 31, and secured in any convenient means, such as with adjustable clamps 56. The collars 26, 28, 30 provide swivel mounts for the arms 27, 29, 31, such that the arms 27, 29, 31 can rotate freely around the pole 12. For example, the collars 26, 28, 30 can be T-connectors used to swivelly connect PVP pipes. The arms 27, 29, 31 can be formed from PVP pipe sections or other similar material. Preferably, the arms 27, 29, 31 are rigid and padded with impact absorbing material, such as foam. At their outer ends, the arms 27, 29, 31 may be provided with detachable targets 32, 34, 36. The targets 32, 34, 36 may be padded martial arts targets of the type used to practice kicking and or punching. Preferably, the targets are padded on both the front and back sides to allow the trainee to hit the target spinning in either direction.

Figure 4:
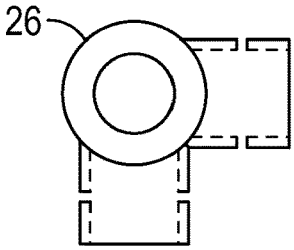
FIG. 4 is a top plan view of an alternative embodiment of the collar having dual mounting points for two arms.
Figure 5:
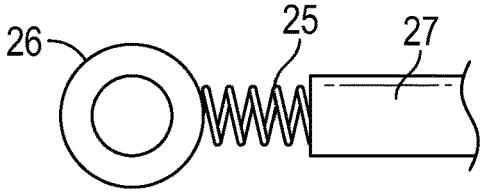
FIG. 5 is a view taken along 5-5 of FIG. 1 showing a spring connection between the collar and the arm.

As an alternative, one or more of the collars 26, 28, 30 may include two attachments points for attaching more than one arm. For example, as shown in FIG. 4, the collar 26A has two receivers 39 set 90° apart upon which a pair of arms can be mounted. As another variation, the receivers 39 can be set 180° apart so that the arms extend from opposite sides of the pole 12. As a further alternative, one or more the collars may be lockable in a static configuration so that the attachment (e.g., arm) does not swivel around the pole 12. For the locking collars, a spring connection may be provided between the arm and the collar to absorb impact that would otherwise be transmitted to the pole 12. For example, a spring 25 can be provided between the collar 26 and the arm 27, as shown in FIG. 5.

A strike target 38 may be provided on the central portion 18 of the pole 12. This strike target 38 may be a speed bag or the like. In a preferred embodiment the strike target 38 is slidable on the pole 12 to be adjusted to a desired height, for example to mimic the position of an opponent's head. More than one strike target 38 may be provided on the central portion 18 of the pole 12.

The apparatus 10 of FIG. 1 is configured for a user to practice striking, blocking, and dodging simultaneously. The arms 27, 29, and 31 can be adjusted on the pole 12 to mimic heights of various punches and kicks. As the arms 27, 29, 31 rotate about the pole 12 in either direction, the user can practice blocking the arms and dodging or avoiding the arms 27, 29, 31 while striking one of the targets 32, 34, 36, and/or 38. The multiple moving arms 27, 29, 31 can provide a simulation of an opponent that is able to strike with multiple limbs in quick succession. The device 10 provides a vigorous workout for a user who must have spatial awareness of several moving elements simultaneously. For example, a user may duck or weave out of the way of the upper arm 27, while blocking arms 29 and 31 and periodically striking the target 32, 34, 36, 38.

FIG. 2 shows an alternative configuration of the apparatus 10. According to this configuration, a double-ended speed bag 40 or similar strike target is suspended from the top arm 27 by a resilient or elastic member 42, such as a bungee cord. A weight 44 is attached to the lower end of the double-ended speed bag 40 by connection member 46, such as a strap or cord, having an adjustable length and which may be elastic. To provide additional support, a support arm 48 may be provided between the outer end of the top arm 27 and the middle collar 28. A T-connector may be provided at the distal portion of the top arm 27 to connect to the support arm 48. Angled elbow connectors 52 may be used to connect the support arm 48 to the T-connector 50 and to the collar 28. In use, the double-end bag 40 reacts in an unpredictable dynamic manner when struck due to the movement permitted by the rotation of the arms 27 and 48 at the pole 12 by the collars 28, 26 and the elastic members 42, 46. Thus, the user has to adapt to the movement of the bag 40. One of the arms can also be rotated to teach the user to bob and weave while attacking the bag. The lower end of the bag can also be attached to the pole. Accordingly, it is good training for a user in that the device 10 mimics the unpredictable moves of an opponent. If the collars 26, 28 are of the type that can be locked in a static configuration, a user will also have the option of using the system in a manner such that the double ended speed bag 40 reacts in a more typical fashion to a conventional double ended speed bag that has its top and bottom supports mounted in a static location.

Therefore, an improved martial arts training apparatus has been disclosed. The present invention contemplates numerous variations, options, and alternatives, and is not to be limited to these specific embodiments described herein. For example, the selected materials and hardware may be selected to suit the intended use. Other changes are considered to be part of the present invention.

What is claimed:

1. A martial arts training device comprising:

a pole comprising a top end and bottom end;

the pole being extendable to create a friction fit between a floor and a ceiling;

the top end of the pole being anchored to the ceiling;

said pole oriented in a generally vertical direction;

one or more arm members each comprising a first end and a second end, with the first end rotatably attached to the pole, wherein in the one or more arm members are configured to rotate around the pole independently;

said one or more arm members oriented in a generally horizontal direction; and a double-ended speed bag suspended from the second end of one of the arm members by an elastic member;

whereby in use, the double-ended speed bag reacts in an unpredictable dynamic manner when struck due to the movement permitted by the rotation of the one of the arm members.

2. The martial arts training device of claim 1, wherein a lower end of the double-ended speed bag is attached to a weight via an adjustable length connection member.

3. The martial arts training device of claim 1 further comprising a support arm extending between a rotatable collar on the pole and the one of the one or more arms.

4. The martial arts training device of claim 1, wherein in the one or more arm members are slidably positioned along the length of the pole.

5. An in-home martial arts training system for practicing blocking, striking, and dodging, the system comprising:

a support pole, the support pole having an upper end and a lower end, the upper end being provided with ceiling engaging hardware and the lower end being provided with floor engaging hardware, the pole including a length adjustment mechanism to adjust a distance between the ceiling engaging hardware and the floor engaging hardware;

an upper collar rotatably mounted on the pole, the upper collar being adapted to detachably receive an upper arm such that the upper arm extends transversely away from the pole and such that the upper arm will rotate freely around the pole;

a middle collar rotatably mounted on the pole, the middle collar being adapted to detachably receive a middle arm such that the middle arm extends transversely away from the pole and such that the middle arm will rotate freely around the pole;

a lower collar rotatably mounted on to the pole, the lower collar being adapted to detachably receive a lower arm such that the lower arm extends transversely away from the pole and such that the lower arm will rotate freely around the pole; and a double-ended speed bag hangably attachable to one of the arms on a resilient member whereby in use, the double-ended speed bag reacts in an unpredictable dynamic manner when struck due to the movement permitted by the rotation of the one of the arms.

6. The in-home martial arts training system of claim 5 wherein the collars are selectively slidable along the pole and wherein the apparatus further comprises securing hardware for securing the collars in fixed vertical positions on the pole.

7. The in-home martial arts training system of claim 5 further comprising a target on the end of the middle arm and a lower target on the end of the lower arm.

8. The in-home martial arts training system of claim 7 wherein the middle and lower targets are selected from the group comprising a padded arm, padded target, or speed bag.

9. The in-home martial arts training system of claim 5 wherein the arms are padded.

10. The in-home martial arts training system of claim 5, further comprising a support arm operably mounted between an outer end of the upper arm and the middle collar.

* * * * *